US007298980B2

(12) United States Patent
Ramesh et al.

(10) Patent No.: US 7,298,980 B2
(45) Date of Patent: Nov. 20, 2007

(54) FEED FORWARD AND FEEDBACK TONER CONCENTRATION CONTROL UTILIZING POST TRANSFER SENSING FOR TC SET POINT ADJUSTMENT FOR AN IMAGING SYSTEM

(75) Inventors: Palghat S. Ramesh, Pittsford, NY (US); Eric M. Gross, Rochester, NY (US); Barrett L. Gady, Washington, IA (US)

(73) Assignee: Xerox Corporation, Stamford, CT (US)

( * ) Notice: Subject to any disclaimer, the term of this patent is extended or adjusted under 35 U.S.C. 154(b) by 301 days.

(21) Appl. No.: 11/088,554

(22) Filed: Mar. 24, 2005

(65) Prior Publication Data

US 2006/0216045 A1 Sep. 28, 2006

(51) Int. Cl.
*G03G 15/08* (2006.01)

(52) U.S. Cl. ..... 399/27; 399/49; 399/60

(58) Field of Classification Search ..... 399/9, 399/24, 27, 38, 46, 49, 58, 59, 60, 61
See application file for complete search history.

(56) References Cited

U.S. PATENT DOCUMENTS

| | | | | |
|---|---|---|---|---|
| 5,166,729 | A | 11/1992 | Rathbun et al. | |
| 6,978,109 | B2 * | 12/2005 | Shoji et al. | 399/274 |
| 7,079,794 | B2 * | 7/2006 | Forbes et al. | 399/257 |
| 7,085,506 | B2 * | 8/2006 | Forbes et al. | 399/29 |
| 7,158,732 | B2 * | 1/2007 | Mo et al. | 399/49 |

* cited by examiner

*Primary Examiner*—Hoan Tran
(74) *Attorney, Agent, or Firm*—Lloyd F. Bean, II

(57) ABSTRACT

A toner concentration control system for maintaining image quality in a developer structure, the toner concentration control system including: a transfer efficiency estimator for measuring a transfer efficiency estimate associated with a developed image on an imaging surface before and after transfer; and a toner dispenser, responsive to the transfer efficiency estimator, for adjusting a toner dispense rate.

19 Claims, 10 Drawing Sheets

FEED FORWARD AND FEEDBACK TONER CONCENTRATION CONTROL UTILIZING POST TRANSFER SENSING FOR TC SET POINT ADJUSTMENT FOR AN IMAGING SYSTEM

FIELD OF THE INVENTION

The present invention generally relates to an imaging system, and more specifically, a method and apparatus for accurately controlling image quality by defining toner dispensing requirements in an imaging system.

BACKGROUND AND SUMMARY

With the increase in use and flexibility of printing machines, especially color printing machines which print with two or more different colored toners, it has become increasingly important to monitor the development process so that increased print quality and improved stability can be met and maintained. For example, it is very important for each component color of a multi-color image to be stably formed at the correct toner density because any deviation from the correct toner density may be objectionable in the final composite image. Additionally, deviations from desired toner densities may also cause visible defects in mono-color images, particularly when such images are half-tone images. Therefore, many methods have been developed to monitor the toner development process to detect present or prevent future image quality problems.

Developability is amount of development (toner mass/area) that takes place. Aside from being a function the electrostatic potential field in which the toner resides, the amount is also a function of the toner concentration in the developer housing. Toner concentration (TC) is measured by directly computing the ratio of toner in the developer housing by weight with respect to the weight of carrier in the developer housing (which, as is well known, contains toner and carrier particles).

As indicated above, one benchmark in the suitable development of a latent electrostatic image on a photoreceptor by toner particles is the correct toner concentration in the developer. An incorrect concentration, i.e. too much toner concentration, can result in too much background in the developed image. That is, the white background of an image becomes colored. On the other hand, too little toner concentration can result in deletions or lack of toner coverage of the image. Therefore, in order to ensure good developability, which is necessary to provide high quality images, toner concentration must be continually monitored and adjusted. In order to provide the appropriate amount of toner concentration, toner usage is determined. Through the use of a toner concentration control system having a feed forward component and a feedback component, the toner concentration and toner usage are determined in order to adjust the toner dispenser to dispense the proper amount of toner for a particular job.

In a pure feedback control system for toner concentration (TC), perturbations in toner concentration will be sensed by an in-housing sensor (e.g., Packer sensor, which is shown in U.S. Pat. No. 5,166,729). Though performance is adversely impacted by sensor inaccuracy the approach is also affected by considerable system transport delay. This can result in inadequate control of toner concentration, particularly with frequently varying toner consumption.

However, toner concentration control can be greatly improved by knowing the customer usage in advance. This enables the toner concentration control system to add toner in a feed forward (FF) fashion as prints are made. Thus, according to the prior art, actual images generated by the raster output scanner for the customer were used to estimate actual toner usage. By summing the actual pixels written by the raster output scanner, a proportional amount of toner was dispensed in a feed forward manner. This reduced the load on a feedback portion of the toner concentration control system whose function of adjusting toner dispense to maintain the developed mass per unit area (developability) of images on the photoreceptor was, consequently, made to run with less spurious transient behavior.

Similar or even better results are desired in the control of the magenta, yellow, cyan and black separations of a full process color xerographic device using image on image technology. Image on image technology (IOI) is the process of placing successive color separations on top of each other by recharging predeveloped images and exposing them. Unfortunately, there are large errors in the estimation of yellow, cyan and black toner usage. For example, yellow toner develops to a lesser degree on magenta than on a bare photoreceptor. Cyan toner develops to a lesser degree on yellow toner and magenta toner than on a bare photoreceptor. Black toner develops to a lesser degree on cyan toner, yellow toner and magenta toner than on a bare photoreceptor. This is due to a reduction of raster output exposure through scattering in passing through developed toner layers on the photoreceptor. The reduced light exposure results in a reduced development field, and thus a reduced developed mass compared to the bare portion of the photoreceptor.

In the transfer subsystem (the system that acts to assist the transfer of toner from the intermediate photoreceptive belt or drum to the final media, usually paper) there is no closed loop regulation of transfer performance (usually quantified by transfer efficiency). When transfer degradation occurs, it is first noted by the customer as poor image quality and then a service call is usually initiated. There is a need for measuring transfer degradation in real time and compensating for any degradation with changes in developer dispense. The change in dispense can be to adjust the minimum allowable dispense rate (a 0 or positive value), adjust the toner concentration set point, and/or to provide a short burst of fresh developer into the sump. This would result in longer uptime and more acceptable IQ performance.

Consequently, there is a need to provide a method and apparatus for minimizing the impact of the above problems to maintain the proper amount of toner concentration by dispensing the proper amount of toner to ensure high image quality.

SUMMARY

There is provided a toner concentration control system for maintaining toner concentration in a developer structure, which is connected to a dispenser containing toner, the toner concentration control system comprising: a toner concentration sensor providing estimate of the toner concentration in the developer housing, a feedback dispense unit receiving the toner concentration estimate and transmitting a dispense rate adjustment command based on the toner concentration estimate and a target value, a toner usage estimator, a feed forward dispense unit transmitting a feed forward dispense rate adjustment command based on the toner usage estimate, a transfer efficiency estimator providing a transfer efficiency estimate of a post-transfer image quality value on a photoreceptor; and a feed back TC target adjustment unit receiving the transfer efficiency estimate and transmitting a toner concentration target adjustment command based on the transfer efficiency estimate.

There is also provided a toner concentration control system for maintaining image quality in a developer structure, the toner concentration control system comprising: a transfer efficiency estimator for measuring a transfer efficiency estimate associated with a developed image on an imaging surface before and after transfer and a toner dispenser, responsive to said transfer efficiency estimator, for adjusting a toner concentration target value.

There is also provided an electrostatic printing machine having a toner concentration control system for maintaining image quality in a developer structure, the toner concentration control system comprising: a transfer efficiency estimator for measuring a transfer efficiency estimates indicative with a developed image on an imaging surface before and after transfer; and a toner dispenser, responsive to said transfer efficiency estimator, for adjusting a toner concentration target value based on measured said transfer efficiency estimate compared to a transfer efficiency target value.

There is also provided a method for maintaining image quality in a developer structure in an electrostatic printing machine having a toner concentration control system, comprising: measuring a transfer efficiency estimates indicative with a developed image on an imaging surface before and after transfer; and adjusting a toner concentration target value of a toner concentration control system based on the error signal based upon the measured transfer efficiency estimate compared to a transfer efficiency target value.

There is also provided a toner concentration control system for maintaining toner concentration in a developer structure, which is connected to a dispenser containing toner, the toner concentration control system comprising: a toner concentration sensor providing estimate of the toner concentration in the developer housing, a feedback dispense unit receiving the toner concentration estimate and transmitting a dispense rate adjustment command based on the toner concentration estimate and a toner concentration target value, a toner usage estimator, a feed forward dispense unit transmitting a feed forward dispense rate adjustment command based on the toner usage estimate, a transfer efficiency estimator providing a transfer efficiency estimate of a post-transfer image quality value on a photoreceptor; and a feedback TC target adjustment unit receiving the transfer efficiency estimate and transmitting a toner concentration target adjustment command based on the transfer efficiency estimate.

DETAILED DESCRIPTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined in the appended claims.

Figure 1:
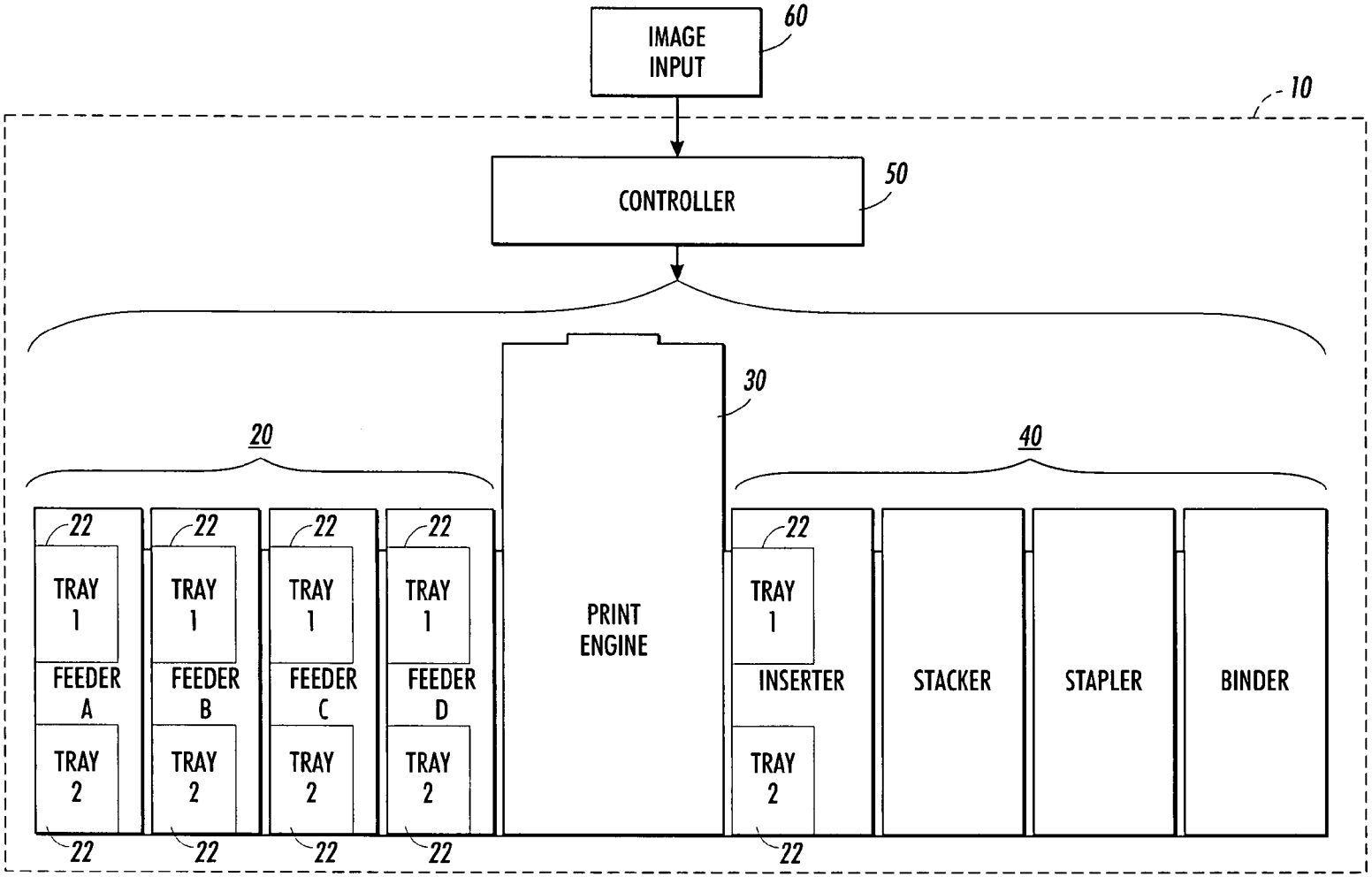
FIG. 1 shows a digital printing system into which the feed forward toner concentration control system may be incorporated.

FIG. 1 shows a digital printing system 10 of the type suitable for use with the preferred embodiment for processing print jobs. As shown, the digital printing system includes document feeders 20, a print engine 30, finishers 40 and controller 50. The digital printing system 10 is coupled to an image input section 60.

Figure 2:
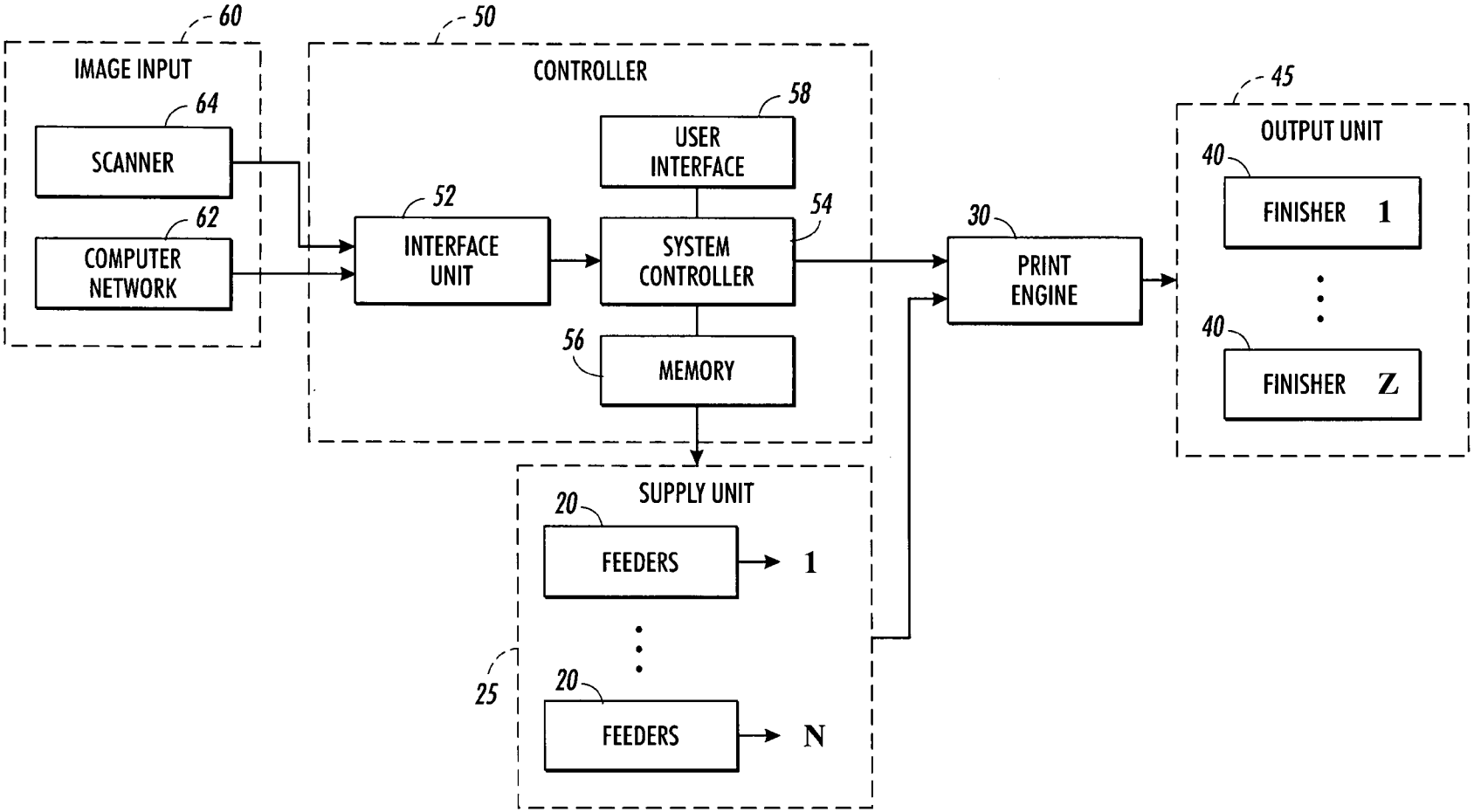
FIG. 2 is a general block diagram of the printing system shown in FIG. 1.

As shown in FIG. 2, the image input section 60 transmits signals to the controller 50. In the example shown, image input section 60 has both remote and onsite image inputs, enabling the digital printing system 10 to provide network, scan and print services. In this example, the remote image input is a computer network 62, and the onsite image input is a scanner 64. However, the digital printing system 10 can be coupled to multiple networks or scanning units, remotely or onsite. Other systems can be envisioned such as stand alone digital printing system with on-site image input, controller and printer. While a specific digital printing system is shown and described, the present invention may be used with other types of printing systems such as analog printing systems.

The digital printing system 10 can receive image data, which can include pixels, in the form of digital image signals for processing from the computer network 62 by way of a suitable communication channel, such as a telephone line, computer cable, ISDN line, etc. Typically, computer networks 62 include clients who generate jobs, wherein each job includes the image data in the form of a plurality of electronic pages and a set of processing instructions. In turn, each job is converted into a representation written in a page description language (PDL) such as PostScript® containing the image data. Where the PDL of the incoming image data is different from the PDL used by the digital printing system 10, a suitable conversion unit converts the incoming PDL to the PDL used by the digital printing system 10. The suitable conversion unit may be located in an interface unit 52 in the controller 50. Other remote sources of image data such as a floppy disk, hard disk, storage medium, scanner, etc. may be envisioned.

The controller 50 controls and monitors the entire digital printing system 10 and interfaces with both on-site and remote input units in the image input section 60. The controller 50 includes the interface unit 52, a system controller 54, a memory 56 and a user interface 58. For on-site image input, an operator may use the scanner 64 to scan documents, which provides digital image data including pixels to the interface unit 52. Whether digital image data is received from scanner 64 or computer network 62, the interface unit 52 processes the digital image data into the document information required to carry out each programmed job. The interface unit 52 is preferably part of the digital printing system 10. However, the components in the computer network 62 or the scanner 64 may share the function of converting the digital image data into the document information, which can be utilized by the digital printing system 10.

As indicated previously, the digital printing system 10 includes one or more feeders 20, print engine 30, finishers 40 and controller 50. Each feeder 20 preferably includes one or more trays 22, which forward different types of support material to the print engine 30. All of the feeders 20 in the digital printing system 10 are collectively referred to as a supply unit 25. Preferably, the print engine 30 has at least four developer stations. Each developer station has a corresponding developer structure. Each developer structure preferably contains one of magenta, yellow, cyan or black toner. The print engine 30 may comprise additional developer stations having developer structures containing other types of toner such as MICR (magnetic ink character recognition) toner. The print engine 30 may also comprise one, two or three developer structures having one, two or three different types of toner, respectively. Further, all of the finishers 40 are collectively referred to as an output unit 45. The output unit 45 may comprise one or more finishers 40 such as inserters, stackers, staplers, binders, etc., which take the completed pages from the print engine 30 and use them to provide a finished product.

Figure 3:
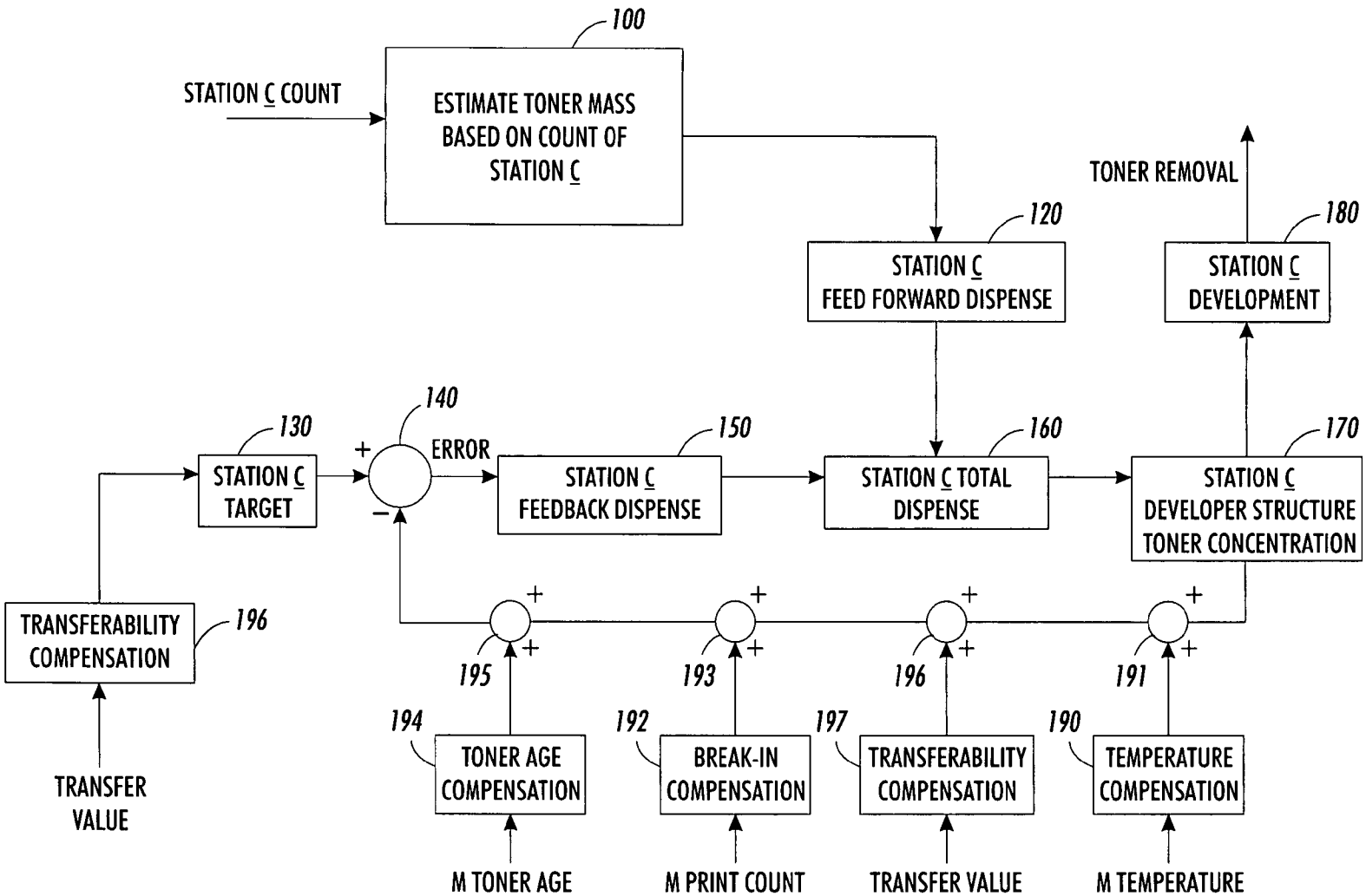
FIG. 3 is a block diagram showing both a feed forward and feedback toner concentration control for the first developer station in accordance with the present invention.

As indicated above, an imaging system typically employs an initial step of charging a photoconductive member to a substantially uniform potential (station A) and thereafter exposing the photoconductive member to record a latent image (station B). FIG. 3 show toner concentration control systems for four developer stations (C-F) for bringing developer including toner particles into contact with the latent image on a photoconductive member. Each of the developer stations is preferably preceded by an exposure process. Further, each of the developer stations preferably includes a developer structure and a corresponding dispenser for supplying toner particles to the developer structure. Preferably, each developer station is applying a different type of toner to the latent image. Preferably, developer station C is applying magenta toner, developer station D is applying yellow toner, developer station E is applying cyan toner and developer station F is applying black toner. As indicated above, additional stations applying other types of toner, such as MICR toner, may be added.

In order to properly bring the toner particles in contact with the latent image, a proper toner concentration must be maintained in each developer structure. Each toner concentration control system comprises a feed forward component and a feedback component to ensure the proper amount of toner is dispensed into each developer structure to maintain the proper toner concentration in each developer structure. By determining the amount of toner required to develop the latent image (feed forward component) and the impact of temperature, break-in and toner age of the toner particles in each developer structure (feedback component), the proper toner concentration in each developer structure is maintained.

Turning first to the feed forward component of the toner concentration control system, the latent image on the photoconductive member has a certain number of pixels to be developed. Each pixel requires a predetermined mass of toner, and the mass of each type of toner is different. The toner required to develop the latent image at each station may be estimated based on the mass of the type of toner at the station and the pixel count of the latent image.

For simplicity one developer station will be describe however same processes are applicably to each developer station C-F. As shown in FIG. 3, the magenta toner mass of developer station C to be applied to the photoreceptor is estimated based on the pixel count of station C (100), and outputted to the station C feed forward dispense 120. The station C feed forward dispense 120 provides a feed forward dispense command to the station C total dispense 160. The station C feed forward dispense 120 provides a feed forward dispense command to request that a certain magenta toner-mass per unit time be dispensed to the developer structure of station C to replace the magenta toner removed from the station C developer structure in order to maintain the proper magenta toner concentration (station C feed forward dispense 120).

The actual developer station C target of magenta toner concentration within the developer structure is generally referred to by reference numeral 130. However, due to the impact of the temperature, break-in and toner age of the magenta toner particles in the developer structure, and due to the type of sensor (preferably a Packer sensor) used to obtain readings to measure magenta toner concentration, the sensor cannot directly measure the actual magenta toner concentration. The sensor readings indicative of the current magenta toner concentration of the developer structure of station C are compensated or corrected for variations in temperature (190), break-in (192), and toner age (194). Then, the compensated or corrected magenta toner concentration is combined with the station C target toner concentration (140) to provide an error signal that is input to the feedback dispense 150. The feedback dispense 150 processes the toner concentration error signal and outputs a feedback command to station C total dispense 160. The station C feedback command provides a dispense command to request that a certain magenta toner mass per unit time be dispensed to compensate or correct for variations in temperature, break-in and toner age in order to maintain the proper magenta toner concentration (station C feed back dispense 150). The transferability compensation unit (196) uses the error between transfer efficiency estimate and a transfer efficiency target value to output a feedback toner concentration target adjustment to the station C target 130.

The total magenta mass of toner dispensed by the station C toner dispenser is determined by combining the station C feed forward dispense command with the station C feedback dispense command. The station C total dispense 160 combines the station C feed forward dispense command with the station C feedback dispense command, and outputs a station C total dispense command so that a certain magenta toner mass per unit time is dispensed from the station C dispenser to the station C developer structure. By dispensing the proper magenta toner mass, the station C developer structure toner concentration (170) is dynamically adjusted to maintain image quality while the magenta toner is being removed from the station C developer structure and adhering to the latent image on the photoreceptor (station C development 180).

This embodiment proposes actuating dispense as a function of the pattern of residual mass post transfer. This is done indirectly by adjusting the TC target as a function of transfer efficiency. Transfer degradation (transfer inefficiency) can be inferred from sensing RMA (residual mass per unit area), or by correlating known transfer degradation states to post transfer image metrics given a specified pattern on the belt. For instance, a particularly simple example is the correlation of transfer degradation state with post transfer residual mass from a solid patch. Applicants have found that transfer efficiency can be influenced by dispense.

Figure 4:
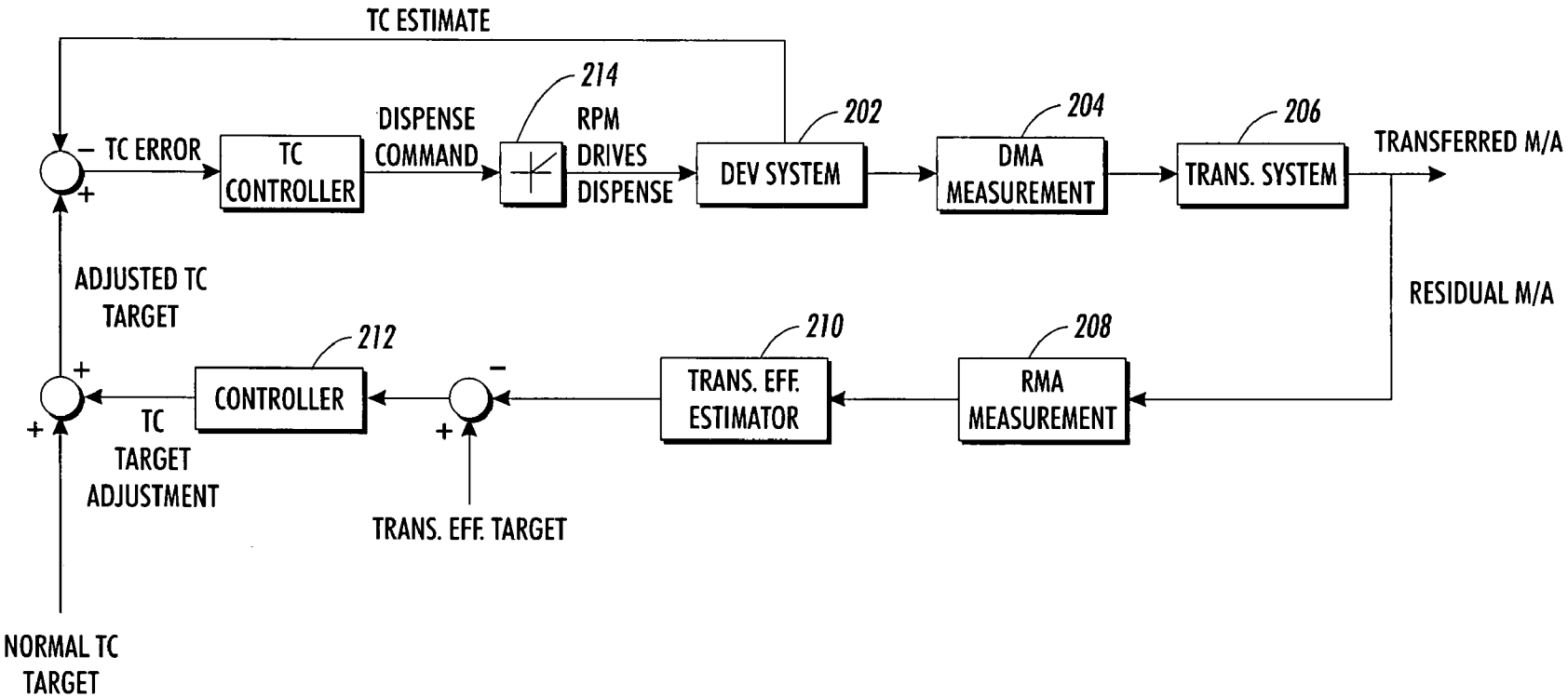
FIG. 4 is a block diagram showing feedback for toner concentration target adjustment in the toner concentration control for transferability compensation in accordance with the present invention.

FIG. 4 is a block diagram showing the feed back toner concentration target adjustment utilizing toner transfer efficiency. In operation, a control patch generator records a control patch on the photoreceptor which is developed by the developer system (202). DMA (developed mass per area) of the control patch is measured by an optical sensor or other type of mass sensor (204). The control patch is transferred to a recording media, such as a sheet (206). The RMA (residual mass per area) of the control patch on the photoreceptor is measured using an optical or other type of mass sensor (208). The ratio of DMA and RMA is calculated to produce an estimate of the transfer efficiency (210). The transfer efficiency is compared with a target value and the error is used by a controller (212) to adjust the toner concentration target (214).

Figure 5:
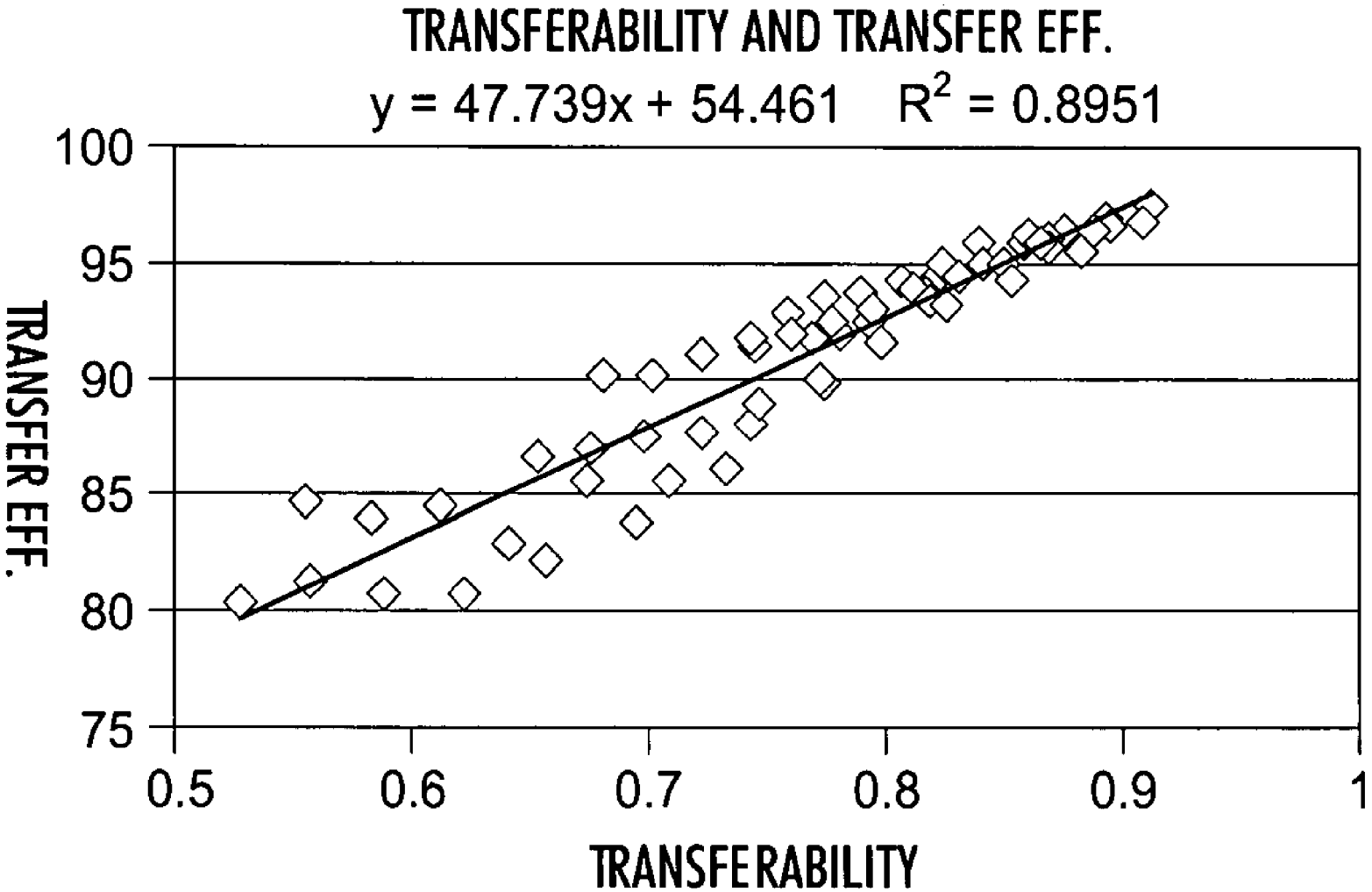
FIG. 5 is experimental data illustrating correlation between transferability and transfer efficiency.
Figure 6:
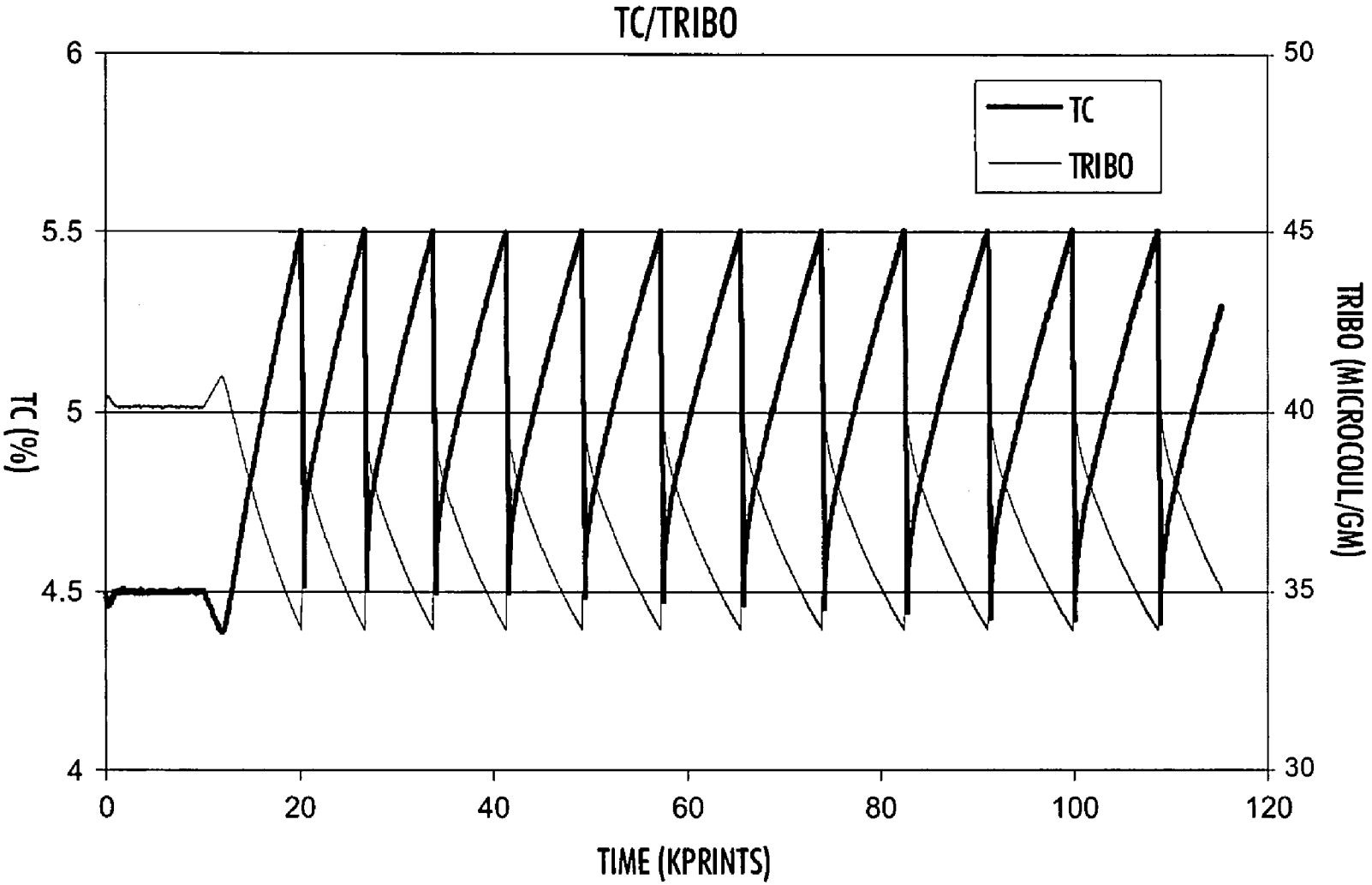
FIGS. 6 through 9 are graphs illustrating transfer control simulation.
Figure 7:
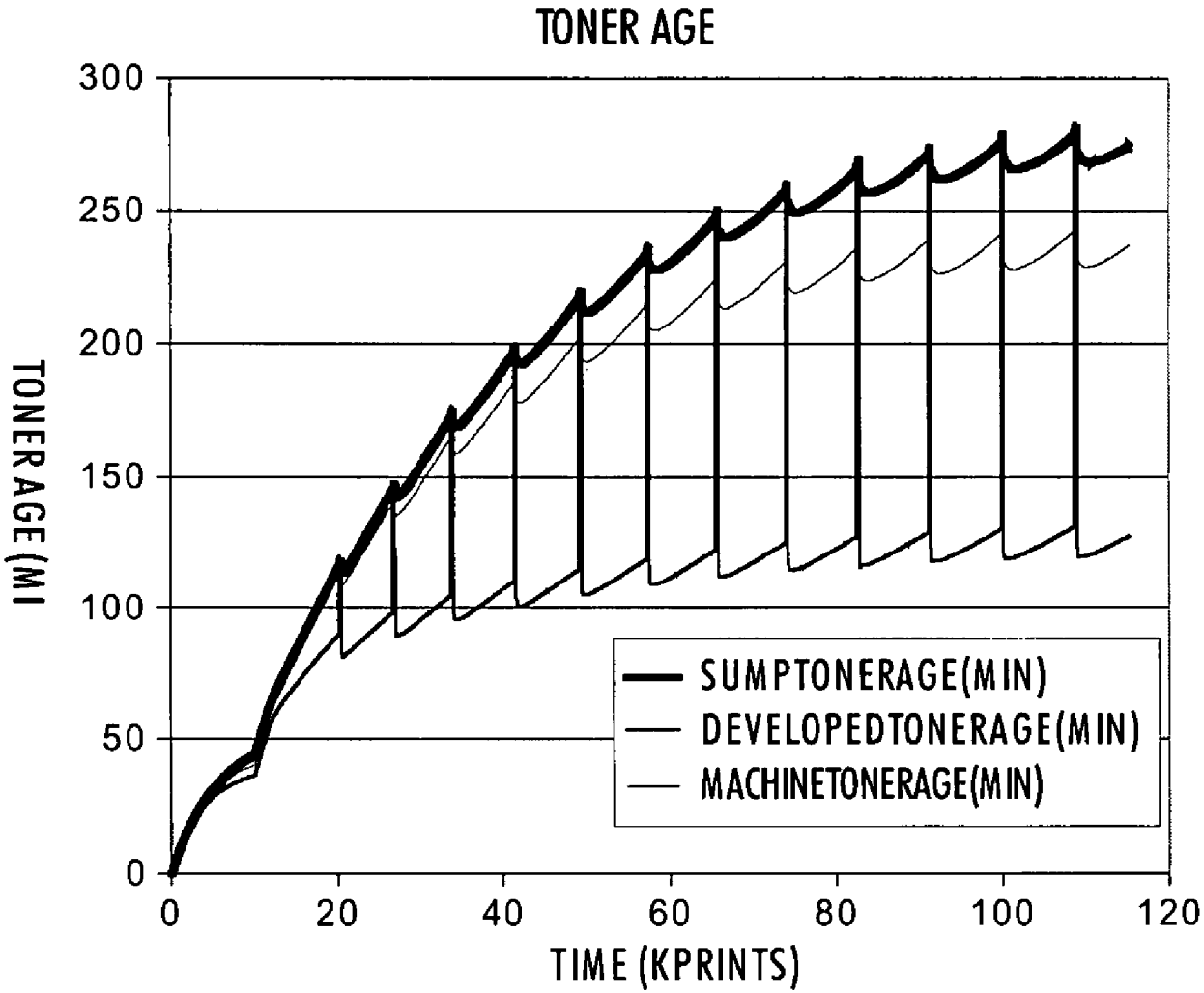
Figure 8:
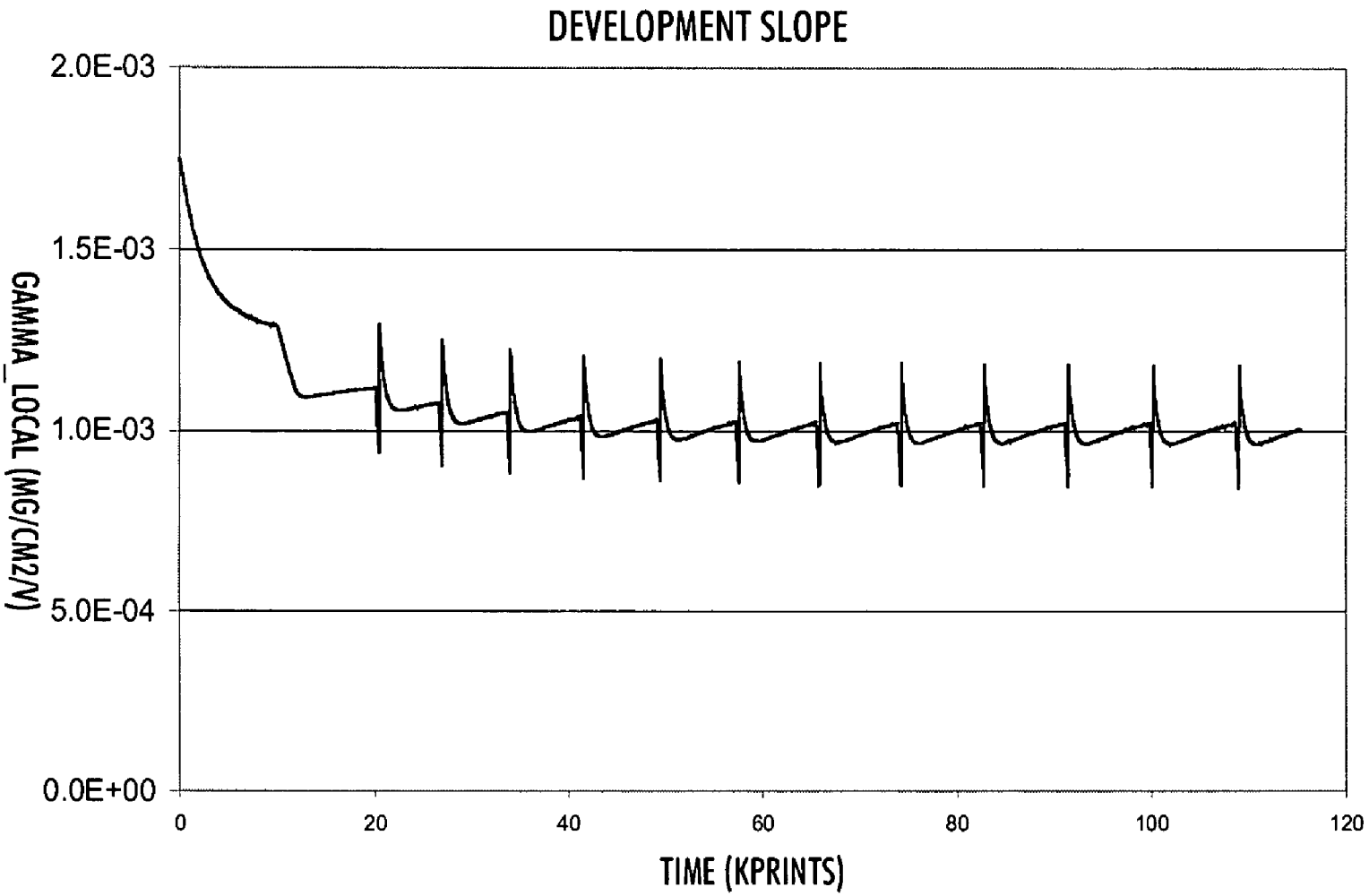

The principles of using dispense to control transfer has been verified with a model. The model considers the toner material state in the sump, on the wires and on the photoreceptor in a development system as shown in FIG. 6. Additive burial as a function of toner residence time in the sump is used to calculate a development probability function. This and development droop due to toner flats building up on the wire determine the local development slope which then determines the development voltage needed to obtain target mass. Additionally, the development probability function (as a function for toner residence time) and the sump toner age distribution determines the additive state of the developed toners on the photoreceptor. The normalized additive state of the developed toners is termed as transferability and is considered to impact the transfer performance. Dispense, injects fresh toners into the sump and changes the development probability function since fresh toners are more easily developed compared to aged toners. Greater fraction of fresh toners on the photoreceptor improves the transferability. Recently the computed transferability has been correlated with measured transfer efficiency (using an RMA sensor) on a printer machine similar to FIG. 10. Results thereof are illustrated in FIG. 5.

FIGS. 6 through 9 show results of simulations of a 100K print job at 0.02% AC. The initial sump TC is 4.5% and RH is 20%. The target transferability is set at 0.6 (equivalent transfer efficiency of about 85%) for this example. Dispense is actuated directly in order to maintain transferability at this level. A consequence of actuating dispense to control variables other than TC is that the system may either overtone or undertone. In the specific case of this simulation the system overtones and a detone procedure is needed to bring the TC down. This detone procedure is identical to the one being used in the minimum dispense algorithms. In the example presented here, about a 95% productivity and 17% toner consumption efficiency is observed. These are much superior to auto toner purge efficiencies and similar to minimum dispense efficiencies. The advantage here however is that PQ is explicitly being controlled.

Figure 10:
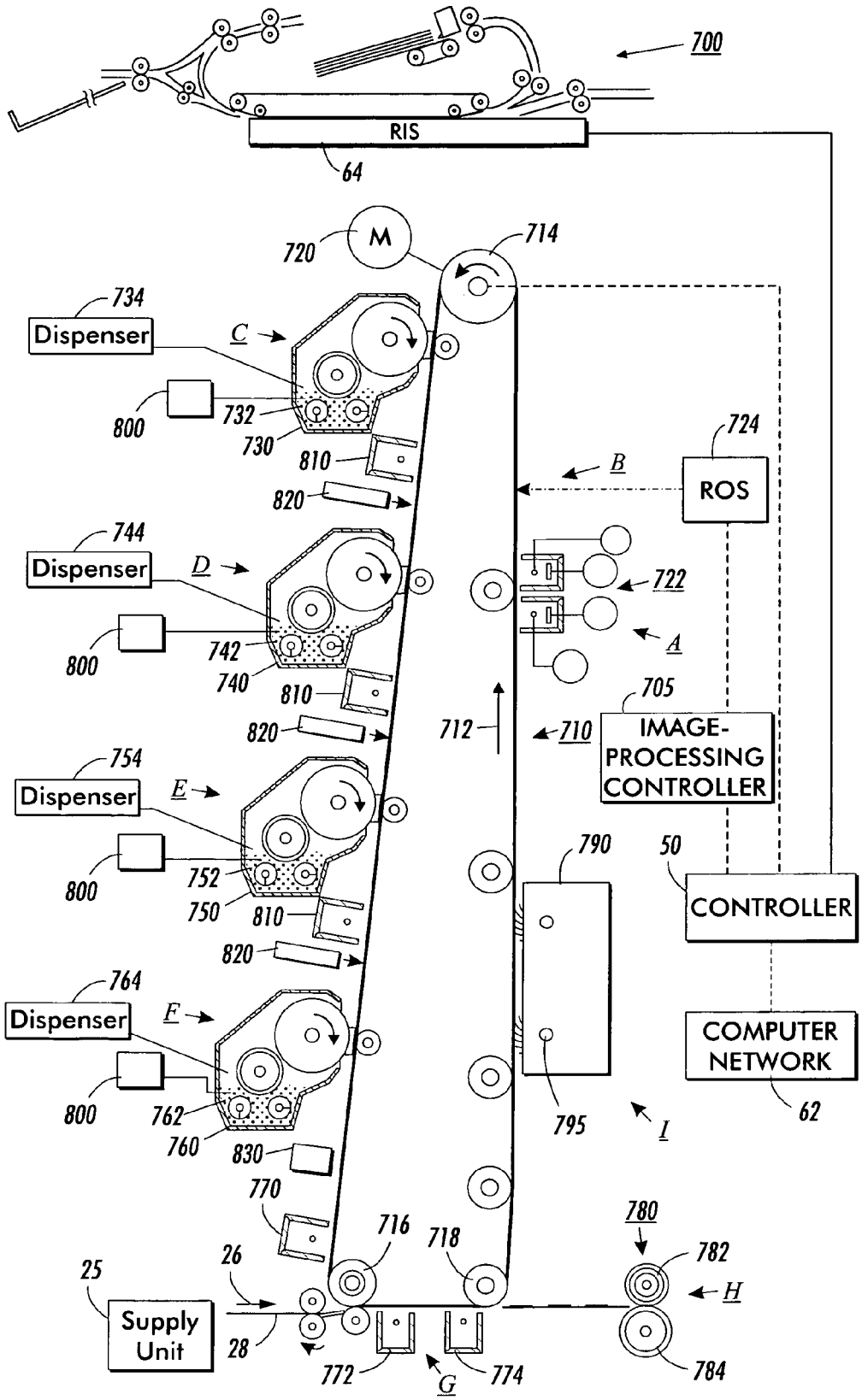
FIG. 10 is a partial schematic elevational view of an example of a digital imaging system, including a print engine, which can employ the toner concentration control system of the present invention.

FIG. 10 is a partial schematic view of a print engine of a digital imaging system, which incorporates the toner concentration control system of the present invention. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

In one embodiment, an original document can be positioned in a document handler 700 on a raster-input scanner (RIS) indicated generally by reference numeral 64. However, other types of scanners may be substituted for RIS 64. The RIS 64 captures the entire original document and converts it to a series of raster scan lines or image signals. This information is transmitted to an electronic subsystem (ESS) or controller 50. Alternatively, image signals may be supplied by a computer network 62 to controller 50. An image-processing controller 705 receives the document information from the controller 50 and converts this document information into electrical signals for the raster output scanner.

The printing machine preferably uses a charge retentive surface in the form of an Active Matrix (AMAT) photoreceptor belt 710 supported for movement in the direction indicated by arrow 712, for advancing sequentially through the various xerographic process stations. The photoreceptor belt 710 is entrained about a drive roller 714, tension rollers 716 and fixed roller 718 and the drive roller 714 is operatively connected to a drive motor 720 for effecting movement of the photoreceptor belt 710 through the xerographic stations. A portion of photoreceptor belt 710 passes through charging station A where a corona generating device, indicated generally by the reference numeral 722, charges the photoconductive surface of photoreceptor belt 710 to a relatively high, substantially uniform, preferably negative potential.

Next, the charged portion of photoconductive surface is advanced through an imaging/exposure station B. At imaging/exposure station B, the controller 50 receives the image signals representing the desired output image from raster input scanner 64 or computer network 62 and processes these signals to convert them to the various color separations of the image. The desired output image is transmitted to a laser based output scanning device, which causes the charge retentive surface to be discharged in accordance with the output from the scanning device. Preferably the laser based scanning device is a laser Raster Output Scanner (ROS) 724. Alternatively, the ROS 724 could be replaced by other xerographic exposure devices such as an LED array.

The photoreceptor belt 710, which is initially charged to a voltage $V_0$, undergoes dark decay to a level equal to about −500 volts. When exposed at the exposure station B, it is discharged to a level equal to about −50 volts. Thus after exposure, the photoreceptor belt 710 contains a monopolar voltage profile of high and low voltages, the former corresponding to charged areas and the latter corresponding to discharged or background areas.

At a first development station C, the development station C preferably utilizes a hybrid development system including a developer structure 730. The development roll, better known as the donor roll, is powered by two development fields (potentials across an air gap). The first field is the ac field which is used for toner cloud generation. The second field is the dc development field which is used to control the amount of developed toner mass on the photoreceptor belt 710. The developer structure 730 contains magenta toner particles 732. The toner cloud causes charged magenta toner particles 732 to be attracted to the electrostatic latent image. Appropriate developer biasing is accomplished via a power supply (not shown). This type of system is a noncontact type in which only toner particles (magenta, for example) are attracted to the latent image and there is no mechanical contact between the photoreceptor belt 710 and a toner delivery device to disturb a previously developed, but unfixed, image. A toner concentration sensor 800 senses the toner concentration in the developer structure 730. A dispenser 734 dispenses magenta toner into the developer structure 730 to maintain a proper toner concentration. The dispenser 734 is controlled by controller 50.

The developed but unfixed image is then transported past a second charging device 810 where the photoreceptor belt 710 and previously developed toner image areas are recharged to a predetermined level.

A second exposure/imaging is performed by device 820 which preferably comprises a laser based output structure. The device 820 is utilized for selectively discharging the photoreceptor belt 710 on toned areas and/or bare areas, pursuant to the image to be developed with the second color toner. Device 820 may be a raster output scanner or LED bar, which is controlled by controller 50. At this point, the photoreceptor belt 710 contains toned and untoned areas at relatively high voltage levels and toned and untoned areas at relatively low voltage levels. These low voltage areas represent image areas which are developed using discharged area development (DAD). To this end, a negatively charged, developer material 742 comprising the second color toner, preferably yellow, is employed. The second color toner is contained in a developer structure 740 disposed at a second developer station D and is presented to the latent images on the photoreceptor belt 710 by way of a second developer system. A power supply (not shown) serves to electrically bias the developer structure 740 to a level effective to develop the discharged image areas with negatively charged yellow toner particles 742. Further, a toner concentration sensor 800 senses the toner concentration in the developer structure 740. A dispenser 744 dispenses magenta toner into the developer structure 740 to maintain a proper toner concentration. The dispenser 744 is controlled by controller 50.

The above procedure is repeated for a third image for a third suitable color toner such as cyan 752 contained in developer structure 750 and dispenser 754 (station E), and for a fourth image and suitable color toner such as black 762 contained in developer structure 760 and dispenser 764 (station F). Preferably, developer structures 730, 740, 750 and 760 are the same or similar in structure. Also, preferably, the dispensers 734, 744, 754 and 764 are the same or similar in structure. The exposure control scheme described below may be utilized for these subsequent imaging steps. In this manner a full color composite toner image is developed on the photoreceptor belt 710. In addition, a permeability sensor 830 measures developed mass per unit area (developability). Although only one sensor 830 is shown in FIG. 12, there may be more than one sensor 830.

To the extent to which some toner charge is totally neutralized, or the polarity reversed, thereby causing the composite image developed on the photoreceptor belt 710 to consist of both positive and negative toner, a negative pre-transfer dicorotron member 770 is provided to condition all of the toner for effective transfer to a substrate.

Subsequent to image development a sheet of support material 28 is moved into contact with the toner images at transfer station G. The sheet of support material 28 is advanced to transfer station G by the supply unit 25 in the direction of arrow 26. The sheet of support material 28 is then brought into contact with photoconductive surface of photoreceptor belt 710 in a timed sequence so that the toner powder image developed thereon contacts the advancing sheet of support material 28 at transfer station G.

Transfer station G includes a transfer dicorotron 772 which sprays positive ions onto the backside of support material 28. This attracts the negatively charged toner powder images from the photoreceptor belt 710 to sheet 28. A detack dicorotron 774 is provided for facilitating stripping of the sheets from the photoreceptor belt 710.

After transfer, the sheet of support material 28 continues to move onto a conveyor (not shown) which advances the sheet to fusing station H. Fusing station H includes a fuser assembly, indicated generally by the reference numeral 780, which permanently affixes the transferred powder image to sheet 28. Preferably, fuser assembly 780 comprises a heated fuser roller 782 and a backup or pressure roller 784. Sheet 28 passes between fuser roller 782 and backup roller 784 with the toner powder image contacting fuser roller 782. In this manner, the toner powder images are permanently affixed to sheet 28. After fusing, a chute, not shown, guides the advancing sheets 28 to a catch tray, stacker, finisher or other output device (not shown), for subsequent removal from the printing machine by the operator.

After the sheet of support material 28 is separated from photoconductive surface of photoreceptor belt 710, the residual toner particles carried by the non-image areas on the photoconductive surface are removed therefrom. These particles are removed at cleaning station I using a cleaning brush or plural brush structure contained in a housing 790. The cleaning brush 795 or brushes 795 are engaged after the composite toner image is transferred to a sheet. Once the photoreceptor belt 710 is cleaned the brushes 795 are retracted utilizing a device incorporating a clutch (not shown) so that the next imaging and development cycle can begin.

Controller 50 regulates the various printer functions. The controller 50 preferably includes one or more programmable controllers, which control printer functions hereinbefore described. The controller 50 may also provide a comparison count of the copy sheets, the number of documents being recirculated, the number of copy sheets selected by the operator, time delays, jam corrections, etc. The control of all of the exemplary systems heretofore described may be accomplished automatically or through the use of user interface 58 from the printing machine consoles selected by an operator. Conventional sheet path sensors or switches may be utilized to keep track of the position of the document and the copy sheets.

Figure 9:
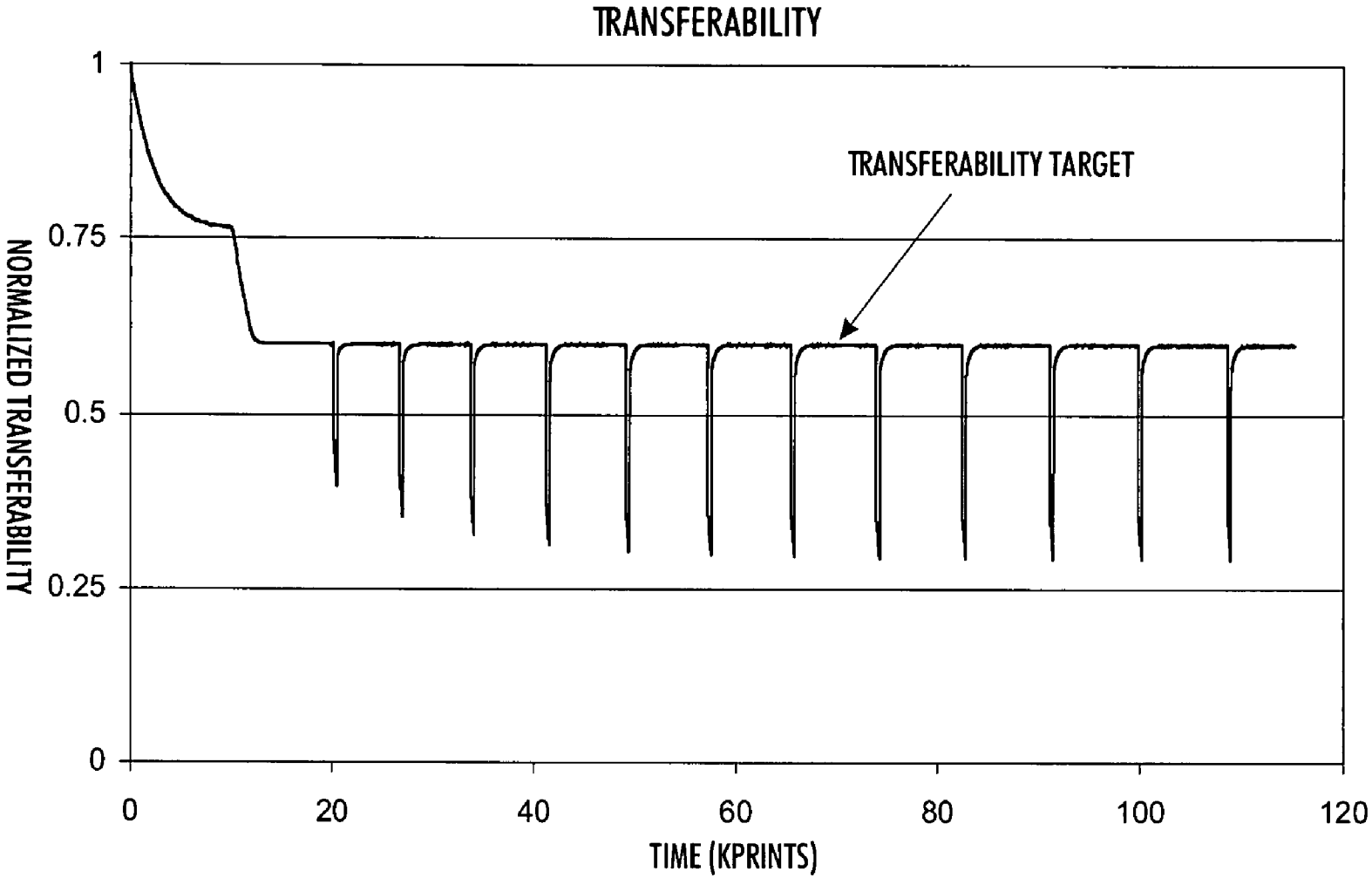

While FIG. 9 shows an example of a digital imaging system incorporating the feed forward toner concentration control and feedback toner concentration control of the present invention, it is understood that this method and apparatus directed toward maintaining the proper toner concentration in developer housings could be used in any imaging system having any number of developer structures.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. A toner concentration control system for maintaining image quality in a developer structure, the toner concentration control system comprising:

a transfer efficiency estimator for measuring a transfer efficiency estimate, said transfer efficiency estimate includes sensed mass areas associated with a developed image on an imaging surface before and after transfer; and a toner dispenser, responsive to said transfer efficiency estimator, for adjusting a toner dispense rate.

2. The toner concentration control system as in claim 1, further comprising a feed back dispense unit for receiving the transfer efficiency estimate and transmitting a teed back dispense command based on the transfer efficiency estimate to said toner dispenser.

3. The toner concentration control system as in claim 1, wherein the transfer efficiency estimator includes a control patch generator for forming a control toner patch on the imaging surface;

a sensor for sensing developed mass area (DMA) and residual mass area (RMA) values of said toner control patch; and a processor for calculating said transfer efficiency estimate from sensed DMA and RMA values.

4. The toner concentration control system as in claim 2, further comprising:

a total dispense unit for receiving a feed forward dispense command and the feedback dispense command, and outputting total dispense command to the dispenser, which dispenses the toner to the developer structure in accordance with a total dispense command.

5. The toner concentration control system as in claim 4, wherein the total dispense command includes a pixel count command.

6. The toner concentration control system as in claim 4, wherein the total dispense command includes a transfer efficiency command.

7. The toner concentration control system as in claim 4, wherein the total dispense command includes a toner age command.

8. The toner concentration control system as in claim 1, wherein the toner is selected from the group consisting of magenta, yellow, cyan and black.

9. An electrostatic printing machine having a toner concentration control system for maintaining image quality in a developer structure, the toner concentration control system comprising:

a transfer efficiency estimator for measuring a transfer efficiency estimate, said transfer efficiency estimate includes sensed mass areas indicative with a developed image on an imaging surface before and after transfer; and a toner dispenser, responsive to said transfer efficiency estimator, for adjusting a toner dispense rate based on measured said transfer efficiency estimate compare to a transfer efficiency target value.

10. The toner concentration control system as in claim 9, further comprising a feed back dispense unit for receiving the transfer efficiency estimate and transmitting a feed back dispense command based on the transfer efficiency estimate to said toner dispenser.

11. The toner concentration control system as in claim 9, wherein the transfer efficiency estimator includes a control patch generator for forming a control toner patch on the imaging surface;

a sensor for sensing developed mass area (DMA) and residual mass area (RMA) values of said toner control patch; and a processor for calculating said transfer efficiency estimate from sensed DMA and RMA values.

12. The toner concentration control system as in claim 9, further comprising:

a total dispense unit for receiving a feed forward dispense command and the feedback dispense command, and outputting total dispense command to the dispenser, which dispenses the toner to the developer structure in accordance with a total dispense command.

13. The toner concentration control system as in claim 12, wherein the total dispense command includes a pixel count command.

14. The toner concentration control system as in claim 12, wherein the total dispense command includes a transfer efficiency command.

15. The toner concentration control system as in claim 12, wherein the total dispense command includes a toner age command.

16. The toner concentration control system as in claim 9, wherein the toner is selected from the group consisting of magenta, yellow, cyan and black.

17. A method for maintaining image quality in a developer structure in an electrostatic printing machine having a toner concentration control system, comprising:

measuring a transfer efficiency estimates, said transfer efficiency estimate includes sensed mass areas indicative with a developed image on an imaging surface before and after transfer; and adjusting a toner dispense rate of a toner dispenser based on the error signal based upon the measured transfer efficiency estimate compare to a transfer efficiency target value.

18. The method as in claim 17, wherein the measuring includes forming a control toner patch on the imaging surface;

sensing developed mass area (DMA) and residual mass area (RMA) values of said toner control patch; and calculating said transfer efficiency estimate from sensed DMA and RMA values.

19. The method as in claim 17, further comprising:

providing a dispense unit for receiving a feed forward dispense command and a feedback dispense command, and outputting total dispense command to the dispenser, which dispenses the toner to the developer structure in accordance with the total dispense command.

* * * * *